US005787983A

United States Patent [19]

Heathman et al.

[11] Patent Number: 5,787,983

[45] Date of Patent: Aug. 4, 1998

[54] METHODS OF DELAYING WELL DESTRUCTION DUE TO SUBSIDENCE

[75] Inventors: James F. Heathman, Katy, Tex.; Jim B. Surjaatmadja, Duncan, Okla.

[73] Assignee: Halliburton Energy Services, Inc., Duncan, Okla.

[21] Appl. No.: 778,492

[22] Filed: Jan. 3, 1997

[51] Int. Cl.[6] ..... E21B 43/00

[52] U.S. Cl. ..... 166/244.1; 175/72

[58] Field of Search ..... 166/244.1, 298, 166/369; 175/72

[56] References Cited

U.S. PATENT DOCUMENTS 5,337,825 8/1994 Marmerstein et al. ..... 166/298 X

*Primary Examiner*—William P. Neuder

*Attorney, Agent, or Firm*—Craig W. Roddy; C. Clark Dougherty, Jr.

[57] ABSTRACT

The present invention provides methods of delaying the destruction of a well as a result of the movement of a subsiding subterranean rock formation penetrated by the well bore. In accordance with the methods, a slot is cut into the subterranean formation in a direction opposite the direction of movement of the formation towards the well bore whereby the well bore extends through the slot as the subterranean formation moves.

23 Claims, 3 Drawing Sheets

METHODS OF DELAYING WELL DESTRUCTION DUE TO SUBSIDENCE

BACKGROUND OF THE INVENTION

1. Field of the Invention

The present invention relates generally to methods of delaying well destruction due to subsidence, and more particularly, to methods of delaying the destruction of a well bore by one or more moving subterranean rock formations.

2. Description of the Prior Art

Oil wells for producing oil from a subterranean oil reservoir are often ultimately destroyed as a result of the movement of one or more subterranean rock formations penetrated by the well due to the subsidence of the formations. That is, when a large volume of oil is produced from a subterranean reservoir by a well, one or more subterranean rock formations above the reservoir which are also penetrated by the well often subside which causes movement of the formations transversely to the well bore. Such movement eventually causes one or more portions of the rock formations to sever or crush casing disposed in the well bore thereby destroying the ability of the well to produce oil through the well bore.

Heretofore, attempts have been made to delay the destruction of wells due to subsidence by drilling an oversized well bore through the rock formations expected to move using under-reaming techniques. Normal sized casing is set in the well bore thereby leaving an annular space around the casing. The existence of the annular space delays the destruction of the casing by one or more subsiding rock formations for a period of time depending upon the rates of movement of the subsiding formations. While such prior art methods have been successful, the delays in the destruction of wells have only been for relatively short periods of time and the under-reaming techniques used have been very expensive.

Thus, there is a need for improved methods of delaying well destruction due to subsidence which increase the lengths of the delays and are relatively inexpensive to perform.

SUMMARY OF THE INVENTION

The present invention provides improved methods of delaying well destruction due to subsidence which meet the needs described above and overcome the deficiencies of the prior art. The methods of this invention can be utilized in the initial construction of wells for producing oil from subterranean oil reservoirs whereby the ultimate destruction of the wells by subsiding rock formations is inexpensively delayed for relatively long time periods. The methods can also be utilized in previously drilled and completed wells containing casing which have not yet been destroyed by subsiding formations.

The methods of constructing a well for producing a subterranean oil reservoir whereby the subsequent destruction of the well due to subterranean formation subsidence is appreciably delayed basically comprise the steps of drilling a well bore into the subterranean oil reservoir to be produced and then cutting a slot or slots into one or more subterranean rock formations which will subside and move transversely to the well bore as a result of oil production. Each slot formed extends from the well bore into a formation in a direction opposite from the expected direction of movement of the formation towards the well bore. Each slot preferably has a width at the well bore approximately equal to or smaller then the diameter of the well bore and a height at least equal to the height of the subterranean formation in which the slot is formed whereby the well bore extends through the slot as the subsiding formation moves relative to the well bore.

When a well containing casing has been drilled and completed in a subterranean oil reservoir and the subsidence of one or more subterranean rock formations above the reservoir has begun but has not yet destroyed the well, the methods of this invention for delaying the destruction of the well basically comprise the following steps. One or more openings are cut in the casing and slots are cut extending from the openings into subsiding rock formations in directions opposite the directions of movement of the formations towards the well bore. The slots preferably have widths and heights as described above. After the openings and slots are formed, the openings in the casing are repaired so that oil subsequently produced through the casing does not enter the slots.

As will be understood, the slots formed in the subsiding formations are extended into the formations as far from the well bore as is practically and economically possible in that the delay in well destruction is directly proportional to the length of the slots. In accordance with the present invention, the openings in the casing and the slots in the moving formations are preferably cut using a fluid jet cutting process and tool.

It is, therefore, a general object of the present invention to provide improved methods of delaying well destruction due to subsidence.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

As mentioned above, when a large volume of oil is produced from a subterranean oil reservoir, the voids left as a result of the production cause subterranean earth formations above the reservoir to subside, i.e., to sink towards the oil reservoir. During the subsidence process, individual subsiding subterranean rock formations in the layers of subterranean formations between the oil reservoir and the surface often move transversely with respect to the well bore. That is, a particular subterranean rock formation extending through top and bottom layers of a different formation may move transversely to the well bore while the contiguous top and bottom layers of the different formation do not move or move very little. Also, contiguous subterranean rock formations often move in opposite directions whereby a well bore passing through the formations will be destroyed more rapidly than is the case where only one of the formations moves. In any event, when a well bore producing oil from a subterranean oil reservoir penetrates subsiding formations above the reservoir, the well bore will ultimately be destroyed by the moving formations.

Figure 1:
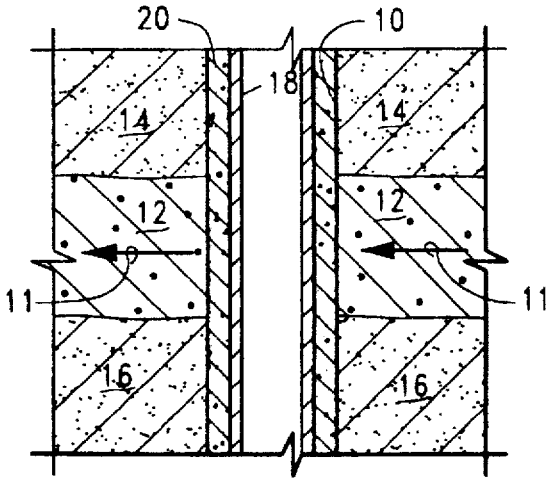
FIG. 1 is a side cross-sectional view of a well bore having casing cemented therein which passes through a subsiding subterranean rock formation.
Figure 2:
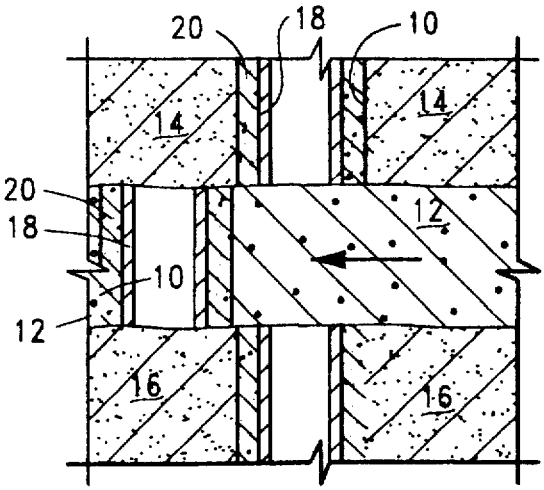
FIG. 2 is a side cross-sectional view of the well bore of FIG. 1 after the well bore has been severed and destroyed by the movement of the subsiding formation.

Referring now to the drawings and particularly to FIGS. 1 and 2, a well bore 10 is illustrated penetrating a subsiding formation 12 which is moving transversely to the well bore 10 as shown by the arrows 11. The formation 12 is sandwiched between an upper contiguous formation 14 and a lower contiguous formation 16 which move very little or move at a slower rate than the formation 12 in the opposite direction. A string of casing 18 is disposed in the well bore 10 which is bonded to the walls of the well bore 10 by the usual cement sheath 20.

After a period of time which is proportional to the rate of relative movement between the formation 12 and the contiguous formations 14 and 16, the oil producing ability of the well bore 10 is destroyed by the transverse movement of the formations as shown in FIG. 2. That is, the relative movement of the formations 12, 14 and 16 causes the formation 12 to move through the well bore 10 which severs a corresponding portion of the well bore 10, casing 18 and cement sheath 20. Depending upon the particular types of subsiding formations involved and their relative movement, the casing 18 can be severed as shown, crushed or flattened.

In accordance with the methods of the present invention, the destruction of a well as a result of subsidence is delayed for a relatively long period of time while incurring a relatively low cost. The methods can be employed in the initial construction of a well for producing oil from a subterranean oil reservoir or the methods can be employed in a previously drilled and completed well which has produced oil from a subterranean oil reservoir to the point where subsidence of one or more subterranean rock formations penetrated by the well bore has started.

Figure 3:
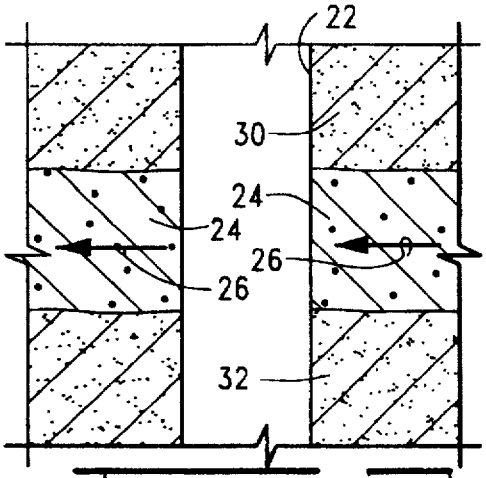
FIG. 3 is a side cross-sectional view of a well bore penetrating a subsiding subterranean rock formation.

Referring now to FIGS. 3–8, and particularly to FIG. 3, in performing the methods of this invention of constructing a well for producing oil from a subterranean oil reservoir while delaying destruction of the well as a result of subsidence, a well bore 22 is drilled into the subterranean oil reservoir (not shown). The well bore 22 penetrates a subterranean formation 24 which is expected to subside and move in the direction shown by the arrows 26.

Figure 4:
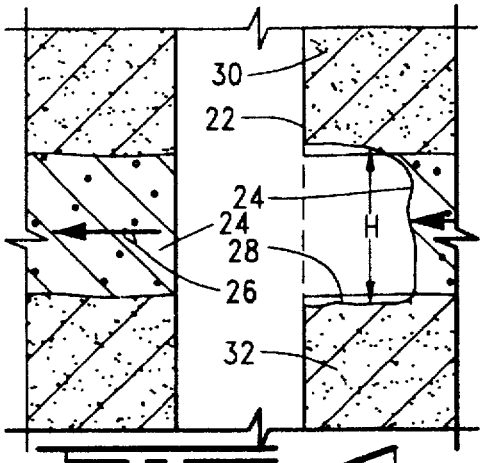
FIG. 4 is a side elevational view of the well bore of FIG. 3 after a slot has been cut into the subsiding formation.

Referring now to FIG. 4, after the well bore 22 has been drilled, a slot 28 is cut into the formation 24 which extends from the well bore 22 in a direction opposite the expected direction of movement of the formation 24 towards the well bore 22. Referring to both of FIGS. 4 and 6, the slot 28 has a width W (FIG. 6) at the well bore which is approximately equal to or smaller than the diameter of the well bore and a height H (FIG. 4) at least equal to the height of the subterranean rock formation 24. The length L (FIG. 6) of the slot 28 is as long as possible to thereby delay the destruction of the well bore 22 for as great a time as possible. That is, as the subsiding rock formation 24 moves in the direction indicated by the arrows 26, the well bore 22 extends through the slot 28 and is prevented from being destroyed by the existence of the slot 28 for a time period approximately equal to the time required for the formation 24 to move a distance equal to the length L of the slot 28.

Figure 5:
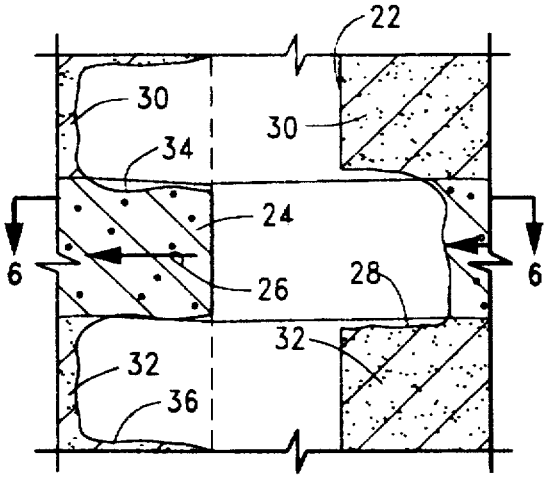
FIG. 5 is a side elevational view of the well bore of FIG. 4 after additional slots have been cut into subterranean formations which are contiguous to the subsiding formation in which a slot was previously cut.
Figure 6:
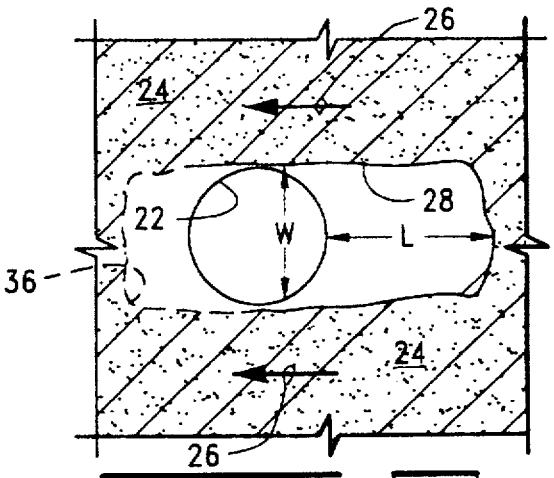
FIG. 6 is a cross-sectional view taken along line 6—6 of FIG. 5.

When the contiguous formations 30 and 32 above and below the formation 24, respectively, are not expected to move as a result of subsidence or are expected to move very slowly in directions opposite to the direction of movement of the formation 24, it is not necessary to cut slots in the formations 30 and 32 in order to delay the destruction of the well bore 22 for some period of time. However, when the answer to the questions of whether or not the formations 30 and 32 will move and if so how rapidly are unknown, slots 34 and 36 are preferably formed in the contiguous formations 30 and 32 as shown in FIGS. 5 and 6. That is, the slots 34 and 36 extend from the well bore 22 into the contiguous formations 30 and 32, respectively, in the expected directions of movement of the formations 30 and 32 which is generally opposite from the direction of the slot 28 in the formation 24. Thus, the slots 34 and 36 in the contiguous formations 30 and 32 provide additional delay if the contiguous formations 30 and 32 move towards the well bore 22. Also, if the formations 30 and 32 do not move or move slowly as compared to the movement of the formation 24, the space between a string of casing disposed in the well bore 22 (not shown) and the contiguous formations 30 and 32 delay the contact of the casing with the formations 30 and 32 when the casing is contacted by the formation 24 and forced in the direction of the formations 30 and 32.

While as mentioned above, the widths of the slots 28, 34 and 36 can be approximately equal to the diameter of the well bore 22, the widths of the slots can also be considerably less than the diameter of the well bore so long as casing disposed in the well bore will be forced into the slots without being destroyed as the formations containing the slots move relative to the casing. In deviated well bores, it is often beneficial to cut the slots with widths less than the diameter of the well bore to provide support for casing when it is run in the well bore thereby preventing it from entering a slot and becoming stuck.

Figure 7:
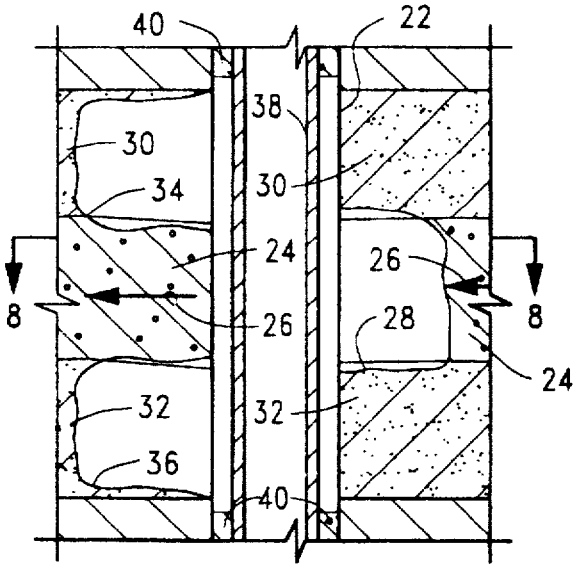
FIG. 7 is a side cross-sectional view of the well bore of FIG. 5 after the casing has been installed therein.

After the slot 28 is formed in the subsiding formation 24 or after the slot 28 is formed and the additional slots 34 and 36 are formed in the contiguous formations 30 and 32, a string of casing 38 is set in the well bore 22 as shown in FIG. 7. The slots 28, 34 and 36 can be left empty or filled with drilling fluid, and the string of casing 38 can be cemented to the well bore 22 by annular cement sheaths 40 above and below the formations 24, 30 and 32 as also shown in FIG.

7. Alternatively, the slots 28, 34 and 36 can be filled with a soft material such as a semi-solid cross-linked aqueous polymer solution, a solid cementitious material which is resilient or readily fractures and crumbles when a force is exerted on it, or other similar material. When a soft material is placed in the slots 28, 34 and 36, the casing string 38 can be conventionally cemented in the well bore 22 whereby the resulting cement sheath 40 also extends through the formations 24, 30 and 32.

Figure 8:
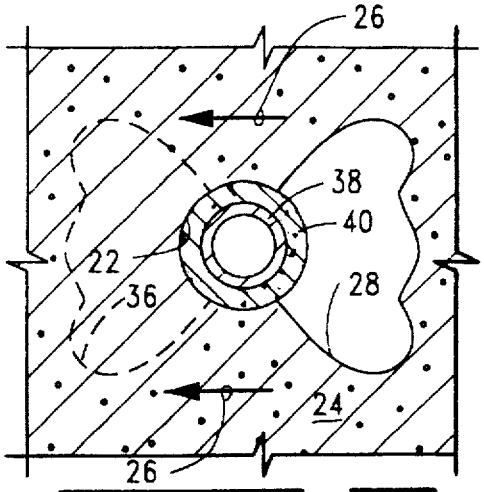
FIG. 8 is a cross-sectional view taken along line 8—8 of FIG. 7.

Referring now to FIG. 8, when the slots in the formations 24, 30 and 32 are formed using a conventional fluid jet cutting tool which is preferred as will be described hereinbelow, the slots produced have the horizontal cross-sectional shapes illustrated in FIG. 8. Such slots are referred to hereinbelow as "petal shaped" slots.

Figure 9:
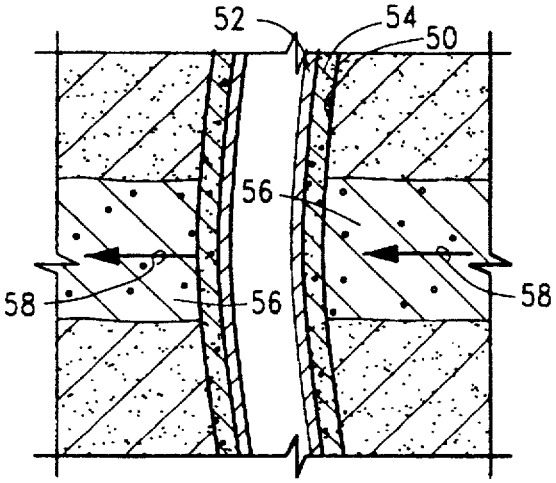
FIG. 9 is a side cross-sectional view of a well bore containing casing which extends through a subsiding subterranean rock formation.
Figure 10:
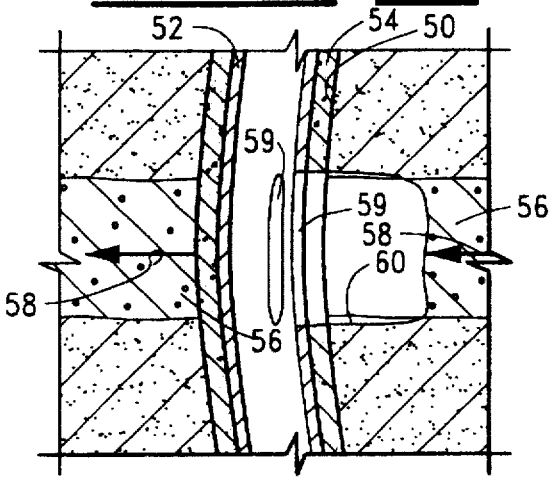
FIG. 10 is a side cross-sectional view of the well bore of FIG. 9 after openings in the casing and cement and a slot in the subsiding formation have been formed.
Figure 11:
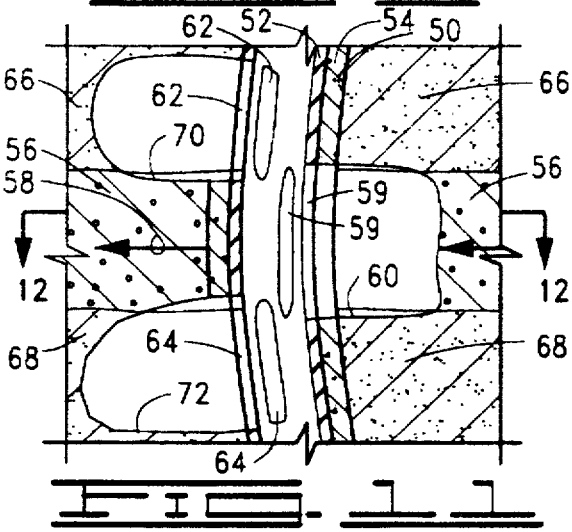
FIG. 11 is a side cross-sectional view of the well bore of FIG. 10 after openings have been cut in the casing and cement and slots have been formed in the formations which are contiguous to the subsiding formation in which a slot was previously cut.
Figure 12:
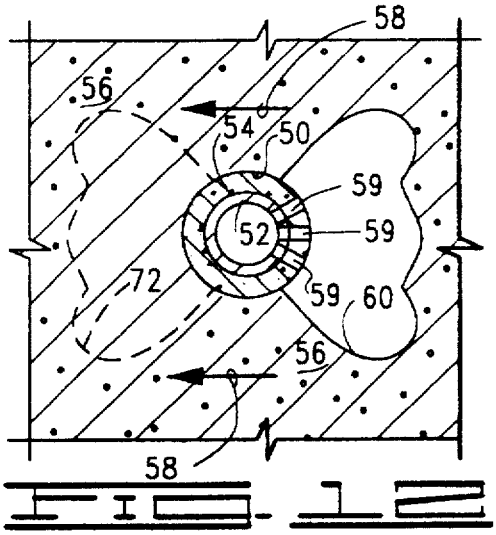
FIG. 12 is a cross-sectional view taken along line 12—12 of FIG. 11.
Figure 13:
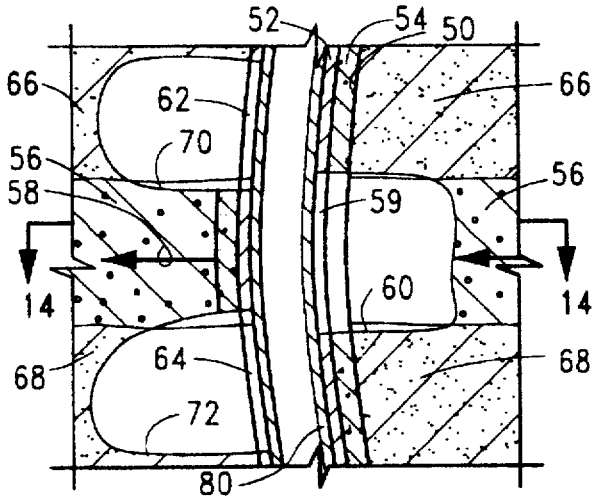
FIG. 13 is a side cross-sectional view of the well bore of FIG. 11 after the openings formed in the casing have been repaired.
Figure 14:
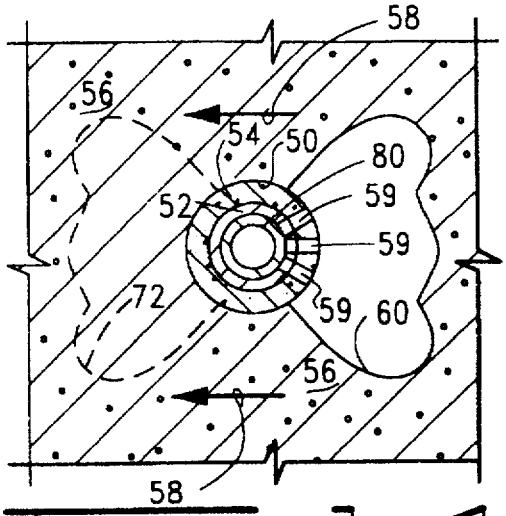
FIG. 14 is a cross-sectional view taken along line 14—14 of FIG. 13.

Referring now to FIGS. 9–14, and particularly FIG. 9, a well bore 50 containing casing 52 and a cement sheath 54 is shown extending through a formation 56, the subsidence of which has just begun causing it to begin movement in the direction shown by the arrow 58. In performing the methods of this invention for delaying the destruction of the well bore 50 as a result of the subsidence of the formation 56, one or more openings 59 (three are shown) are cut through the casing 52 and cement sheath 54, and a petal shaped slot 60 is cut into the subsiding formation 56 using a fluid jet cutting tool (not shown) in a direction opposite the direction of movement of the formation 56 as shown in FIGS. 10 and 12. As described above, the slot 60 preferably has a width at the well bore 50 which is approximately equal to or smaller than the diameter of the well bore 50 and a height at least equal to the height of the subsiding formation 56. Additional openings 62 and 64 are cut in the casing 52 and cement sheath 54 adjacent to the formations 66 and 68 which are contiguous to the formation 56, and petal shaped slots 70 and 72 are cut into the contiguous formations 66 and 68, all as shown in FIGS. 11 and 12. As also described above, the slots 60, 70 and 72 can be left empty, left filled with drilling fluid or filled with a soft semi-solid or solid material. Thereafter, the openings 58, 62 and 64 in the casing 52 are repaired by sealingly installing a liner 80 within the casing 52 as shown in FIGS. 13 and 14 or by other similar casing repair procedures.

While a variety of conventional downhole procedures and tools can be utilized for cutting the openings and slots described above, a conventional fluid jet cutting procedure known in the art as "hydrajetting" and a conventional fluid jet cutting tool are preferred for use in accordance with the present invention. In the hydrajetting process, a liquid, typically water, containing an abrasive material such as sand or the like is discharged from a tool in one or more high velocity jets. Typically, the tool is lowered in a well bore connected to a work string into which the liquid containing abrasive material is pumped at a relatively high rate and pressure. The tool includes at least one nozzle for directing a high velocity jet of the abrasive containing liquid in a direction transverse to the well bore whereby openings in casing and cement contained in the well bore and petal shaped slots in subterranean rock formations can be formed in a relatively quick and inexpensive manner. Most preferably, a hydrajetting tool is utilized which positions a plurality of jet forming nozzles as close to the casing and/or well bore being cut as possible, and which is capable of forming one or more openings through casing and cement and then forming a petal shaped slot in a subterranean rock formation having an initial length L in the range of from about 8 to about 24 inches.

As will be understood by those skilled in the art, the well bores described herein and shown in the drawings can be substantially vertical or deviated (non-vertical). Also, the various subterranean formations can be inclined with respect to the well bores. Thus, the terms "above," "below," "width," "height," "length" and other similar terms as used herein are to be understood as relative terms which are not limited to vertical well bores penetrating horizontal subterranean formations, but apply to all of the various well bore and formation configurations encountered in the art to which this invention is applicable. As will also be understood, a variety of slot shapes can be utilized in accordance with this invention so long as the slots provide sufficient space for casing to pass through during the movement of subsiding formations containing the slots relative to the casing.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. A method of constructing a well for producing oil from a subterranean oil reservoir whereby the subsequent destruction of the well as a result of the movement of a subterranean rock formation penetrated by the well bore due to the subsidence of the formation is delayed comprising the steps of:

drilling a well bore into said subterranean oil reservoir by way of said subterranean rock formation;

cutting a slot extending from said well bore into said subterranean rock formation in a direction opposite the expected direction of movement of said formation towards said well bore whereby said well bore extends through said slot as said subterranean rock formation moves relative to said well bore.

2. The method of claim 1 wherein said slot is petal shaped.

3. The method of claim 1 wherein said slot is cut using a well hydrajetting process and tool.

4. The method of claim 1 which further comprises the step of setting a continuous string of casing in said well bore extending from the surface to said subterranean oil reservoir.

5. The method of claim 4 wherein said slot is filled with a soft material prior to setting said casing in said well bore.

6. The method of claim 1 which further comprises the steps of cutting one or more additional slots extending from said well bore into contiguous formations to said subterranean rock formation, the slots in said contiguous formations extending from said well bore in directions opposite from the direction of said slot in said subterranean rock formation.

7. The method of claim 6 wherein said slots are petal shaped.

8. The method of claim 6 wherein said slots are cut using a well hydrajetting process and tool.

9. The method of claim 6 which further comprises the step of setting a continuous string of casing in said well bore extending from the surface to said subterranean oil reservoir.

10. The method of claim 9 wherein said slots are filled with a soft material prior to setting said casing in said well bore.

11. A method of constructing a well for producing oil from a subterranean oil reservoir whereby the subsequent destruction of the well as a result of the movement of two or more subterranean rock formations penetrated by the well bore due to the subsidence of the formations is delayed comprising the steps of:

drilling a well bore into said subterranean oil reservoir by way of said subterranean rock formations;

cutting slots extending from said well bore into each of said subterranean rock formations in directions opposite the expected directions of movement of said rock formations toward said well bore, said slots each having a width at said well bore approximately equal to or smaller than the diameter of said well bore and a height at least equal to the height of the subterranean formation in which said slot is formed whereby said well bore extends through said slots as said subterranean rock formations move relative to said well bore; and setting a continuous string of casing in said well bore extending from the surface to said subterranean oil reservoir.

12. The method of claim 11 which further comprises the steps of cutting one or more additional slots extending from said well bore into contiguous formations to said subterranean rock formations, each slot in a contiguous formation extending from said well bore in a direction opposite the expected direction of movement of said contiguous formation or in a direction opposite from the direction of the slot in the subterranean rock formation to which the contiguous formation is contiguous.

13. The method of claim 12 wherein said slots are petal shaped.

14. The method of claim 13 wherein said slots are cut using a hydrajetting process and tool.

15. The method of claim 14 wherein said slots are filled with a soft material prior to setting said casing in said well bore.

16. A method of delaying the destruction of a well bore having casing therein which penetrates and produces oil from a subterranean oil reservoir and passes through at least one subterranean rock formation above said oil reservoir which moves due to subsidence comprising the steps of:

cutting at least one opening through said casing and a slot extending into said subterranean rock formation in a direction opposite the direction of movement of said formation towards said well bore whereby said well bore extends through said slot as said subterranean rock formation moves relative to said well bore; and then repairing said opening in said casing so that oil subsequently produced through said casing does not enter said slot.

17. The method of claim 16 wherein said slot is petal shaped.

18. The method of claim 16 wherein said opening and slot are cut using a well hydrajetting process and tool.

19. The method of claim 16 wherein said slot is filled with a soft material prior to repairing said opening in said casing.

20. The method of claim 16 which further comprises the steps of:

cutting one or more additional openings through said casing and additional slots extending into contiguous formations to said subterranean rock formation, the slots in said contiguous formations extending in directions opposite the expected direction of movement of said contiguous formations or in a direction opposite from the direction of said slot in said subterranean rock formation; and then repairing said openings in said casing.

21. The method of claim 20 wherein said slots are petal shaped.

22. The method of claim 20 wherein said openings and slots are cut using a well hydrajetting process and tool.

23. The method of claim 20 wherein said slots are filled with a soft material prior to repairing said openings in said casing.

* * * * *